US005699849A

United States Patent [19]

Fink

[11] Patent Number: 5,699,849

[45] Date of Patent: Dec. 23, 1997

[54] HOT-CHAMBER DIECASTING MACHINE

[75] Inventor: Roland Fink, Winterbach, Germany

[73] Assignee: Oskar Frech GmbH & Co., Schorndorf, Germany

[21] Appl. No.: 592,348

[22] PCT Filed: May 23, 1995

[86] PCT No.: PCT/EP95/01963

§ 371 Date: Feb. 7, 1996

§ 102(e) Date: Feb. 7, 1996

[87] PCT Pub. No.: WO95/33588

PCT Pub. Date: Dec. 14, 1995

[30] Foreign Application Priority Data

Jun. 7, 1994 [DE] Germany ..... 44 19 848.5

[51] Int. Cl.[6] ..... B22D 17/32; B22D 17/04

[52] U.S. Cl. ..... 164/155.4; 164/155.2; 164/318; 164/316

[58] Field of Search ..... 164/155.4, 154.2, 164/457, 316, 317, 318

[56] References Cited

U.S. PATENT DOCUMENTS 5,125,450 6/1992 Kidd et al. ..... 164/457

FOREIGN PATENT DOCUMENTS

| | | | |
|---|---|---|---|
| 21 43 937 | 3/1973 | Germany . | |
| 157 168 | 10/1982 | Germany . | |
| 31 42 811 | 5/1983 | Germany . | |
| 42 16 773 | 11/1993 | Germany . | |
| 42 18 556 | 12/1993 | Germany . | |
| 62-34659 | 2/1987 | Japan | 164/155.4 |
| 63-40661 | 2/1988 | Japan | 164/155.4 |

*Primary Examiner*—Jack W. Lavinder
*Assistant Examiner*—L.-H. Lin
*Attorney, Agent, or Firm*—Evenson, McKeown, Edwards & Lenahan, P.L.L.C.

[57] ABSTRACT

In order to improve the compression operation and to produce better products with thin-walled castings, the invention calls for the compression operation to be divided into three phases and controlled by high-dynamic continuous-operation valves which have very short switching times and are actuated by a control device. Fitted in the hot-chamber die-casting machine for this purpose is a metal sensor which is disposed in a die relief leading from the rising bore in the casting container into the mould.

7 Claims, 1 Drawing Sheet

HOT-CHAMBER DIECASTING MACHINE

BACKGROUND AND SUMMARY OF THE INVENTION

The invention relates to a hot-chamber diecasting machine and, more particularly, to a hot-chamber diecasting machine in which the injection process is influenced by an electronic control device. Input signals coming from the injection assembly are supplied to the electronic control device. The diecasting machine is provided with a casting container that dips into the melt with a riser, and with a mouthpiece body mounted thereon. The mouthpiece body is guided with a nozzle tip up to a mold.

Hot-chamber diecasting machines of this type are known as in German Patent document DE-AS 21 43 937. In these machines, the casting container that dips into the melt is provided with a casting cylinder with a riser and with a mouthpiece body attached thereto, which can be guided up to the mold.

It is known that the diecasting process is one of the most economical manufacturing methods in the casting industry. It is performed with diecasting machines that carry out the injection process in three phases in order to achieve the highest possible product quality. It is known in this regard, as described in German Patent document DE 29 22 914, that in order to control the injection process, one may evaluate either travel-dependent signals or signals that depend on the injection pressure, from which conclusions can be drawn about the respective position of the casting ram and the degree of filling of the mold.

From German Patent document DE 42 16 773 A1, there is disclosed in a cold-chamber diecasting machine, a metal sensor that can be associated with the casting mold. However, the metal sensor described in the German Patent document DE 42 16 773 A1 serves exclusively to deliver a signal in real-time to an evacuation device located downstream from the mold. Due to the signal, a valve located upstream of the vacuum pump is closed before the metal melt reaches the vacuum pump. Other sensors that work with temperature sensors are associated with the casting cylinder as well in such cold-chamber diecasting machines in order to be able to detect and evaluate at least two parameters by means of two evaluation circuits at one point. Finally, so-called continuous valves have also been used, as described in German Patent document DE 42 18 556 A1, for controlling the injection process in cold-chamber diecasting machines, with whose assistance the movement of the casting ram and a multiplying ram can be controlled through the use of devices that measure travel and speed, with a computer being used to control the continuous valve.

In hot-chamber diecasting machines of the type described above, completely different installation conditions prevail. Much less space can be made available and the temperatures at the mouthpiece are very high (approximately 400° C.).

In these hot-chamber diecasting machines, the bath level is one of the main interfering factors. Differences in bath level can lead to different filling processes in the pressure mold. For example, if the bath level is too high, then the mold cavity will already be filled during the first phase. If it is too low, then the second phase starts in the casting container or in the mouthpiece body already, and a blank results which can lead to high pressure peaks.

The goal of the invention is to avoid these disadvantages. This goal is achieved in a hot-chamber diecasting machine in which the injection process is influenced by an electronic control device. Input signals coming from the injection assembly are supplied to the electronic control device. The diecasting machine is provided with a casting container that dips into the melt with a riser, and with a mouthpiece body mounted thereon. The mouthpiece body is guided with a nozzle tip up to a mold. In the vicinity of the tip of mouthpiece body, a metal sensor is provided. The metal sensor is connected with the control device and likewise feeds input signals to it. High-dynamic continuous valves with switching times between 1 and 5 ms are provided to influence the injection process. The valves are actuated by the control device so as to permit speed and pressure regulation suitable for the product.

By virtue of these measures, the position of the metal front can be determined exactly so that, beginning at this point in time, the further flow of the material through the runner head and runners can be clearly determined. At the same time, the injection process can be controlled by means of conventional high-dynamic continuous valves with switching times between 1 and 5 ms. These valves are operated by the control device and permit speed and pressure regulation suitable for the product. With this design, especially when the control device utilizes digital control electronics, digital speed and pressure regulation can be achieved that makes it possible to operate at different points over the entire filling process at different speeds. The dwell pressure can also be freely selected. Thus, it is possible to work in a known manner with display screens to monitor the casting parameters (pressure, speed, and travel). It is also possible with the aid of an additional flexible time to adjust the various molds and feed designs. Thus, for example, it is possible that when the sensor detects material, one can know from the casting parameters on the screen that the first phase must still be slightly prolonged in order to insure optimum venting. This has the great advantage that in contrast to the above-mentioned arrangement of a metal sensor in the mold, the sensor is now associated with the machine at a point that is near the feed bush of the mold, so that it is not necessary to go to the lengths of providing various molds each with one sensor. The design of the various molds, as indicated, can be taken into account by setting an empirically determined flexible time.

In a preferred embodiment of the present invention, the mold can also have associated with it an evacuation device with a vacuum pump and a valve located upstream from the latter. The valve is additionally actuated by the control device. Provision can also be made such that the nozzle tip can be placed in a receptacle in the mouthpiece body so that the metal sensor is then placed in this receiving area of the mouthpiece body. There is also the possibility of providing different nozzle tips without having to change the arrangement of the metal sensor. If metal sensors are provided that operate with zero contact, such as magnetic field sensors or ultrasound sensors that correspond to the metal front, there are no sealing problems when they are installed as otherwise results with sensors that are triggered upon contact with the metal front owing to the high pressures and temperatures.

Other objects, advantages and novel features of the present invention will become apparent from the following detailed description of the invention when considered in conjunction with the accompanying drawings.

DETAILED DESCRIPTION OF THE DRAWINGS

Figure 1:
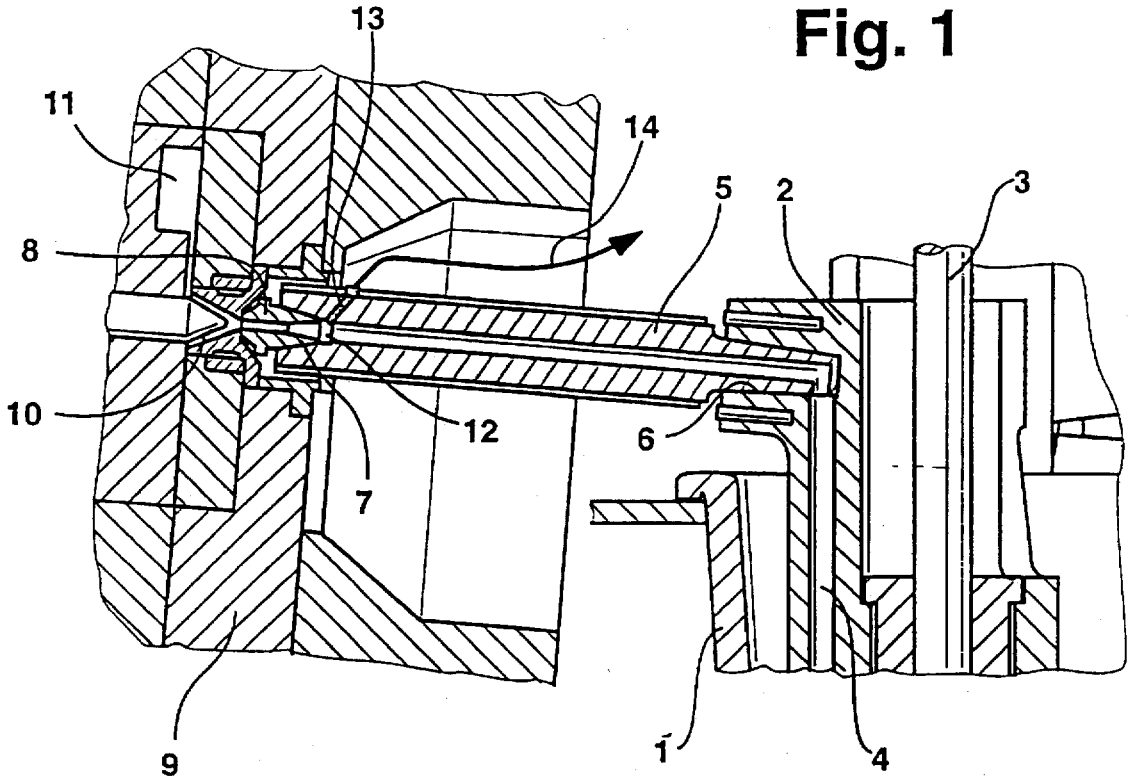
FIG. 1 is a schematic diagram of the end of a riser in a casting container of a hot-chamber diecasting machine with an attached mouthpiece body which extends into the mold and has a metal sensor at the end that is provided with a nozzle tip.

In FIG. 1, the upper end of a casting container (2) submerged in a casting vat (1) is shown. The casting container (2) is provided in a manner not shown in greater detail with a casting ram, which is operable by a drive rod (3). Casting container (2) has a riser (4) whose upper end has a conical receiving opening (6) for insertion of a mouthpiece body (5) The mouthpiece body (5) can be heated in a known fashion and has at its end facing away from the mounting opening (6), a conical receptacle (7) for a nozzle tip (8). The nozzle tip (8) penetrates into a mold (9) whose runners (10) merge with the actual mold chamber (11). In the receiving space (12) formed between the conical receptacle (7) and the nozzle tip (8), a metal sensor (13 projects. The metal sensor (13) is connected by a connecting cable (14) to a control device (15) which can be seen in FIG. 2.

Therefore, if the stream of metal during the casting process reaches the metal sensor (13) at the tip of the mouthpiece body (5), the further progress of the mold filling process can be delicately controlled in a precise manner. Uncertainty as to where the metal stream is located does not exist. Instead of the contact metal sensor shown, sensors that work in a non-contacting manner can also be provided. These sensors are not introduced into the metal stream and have to be sealed off from it, but rather are placed in blind holes that are sealed off from the metal stream. Such sensors can, for example, be magnetic field sensors or ultrasound sensors.

Figure 2:
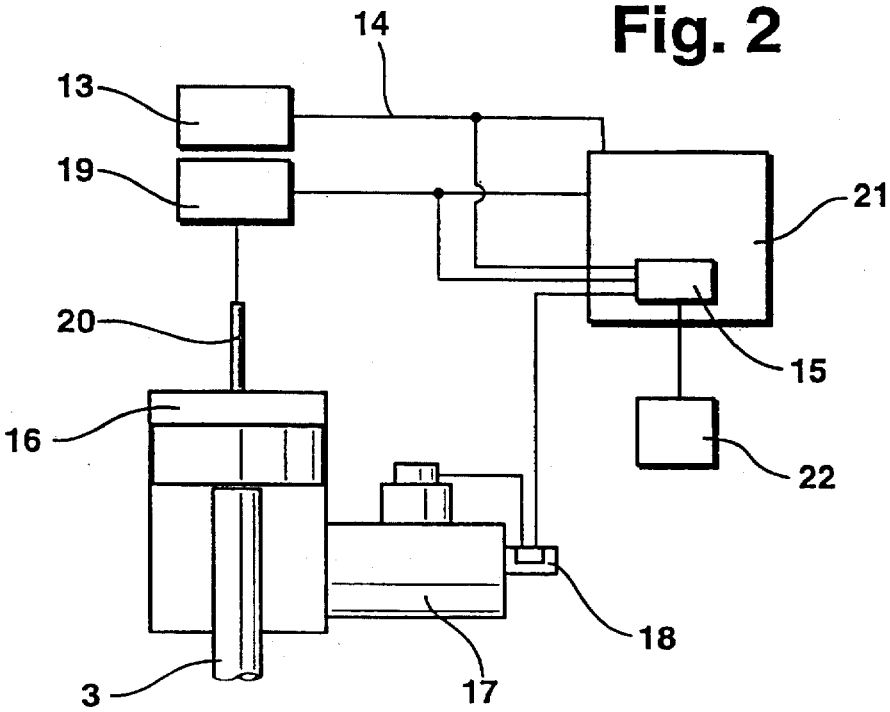
FIG. 2 is a schematic block diagram of the regulating device for the injection process of the hot-chamber diecasting machine in FIG. 1.

FIG. 2 shows that piston rod (3) of the casting piston is guided by a pressure cylinder (16) at whose outflow side a valve (17) is located which is designed as a conventional high-dynamic continuous valve. This valve (17) is operated by a two-stage pre-control valve (18) when a corresponding pulse comes from the control device (15). Control device (15) is designed as a digital control electronic device and, for example, stores the set values for six phases of the injection process. The phases are provided to produce a certain product. Control device (15) permits real-time control and it receives starting pulses for this time control from the metal sensor (13), but it can also obtain them from a travel-dependent scanning device (19) which can be made for example as a shaft encoder, and connected by a suitable device (20) with the ram of the pressure cylinder (16) so that its position within the pressure cylinder (16) can be determined. It is also possible to detect the pressure rise at the nozzle tip by a sensor in the hydraulic system and thus initiate the signal for starting the second phase in which the pressure is considerably increased. Both the travel-dependent values and the signals from the metal sensor (13) can also be fed in a known manner known to a screen (21) that permits a graphic display of the casting parameters at any given time. Finally, the control device (15) can be connected with a valve (22) that is located upstream from a vacuum device (not shown) and downstream from the mold (11). The valve (22) can prevent the metal that flows out of the evacuative mold into the vent runners from reaching the vacuum pump.

Control valve (17) mounted on the outflow side of the casting cylinder operates during the filling phase as a speed regulating valve. The speed is programmed as a function of the casting ram position and the corresponding actual values can be transmitted through the device (19) to the screen and to the control device (15). In the dwell pressure phase, the continuous valve acts as a pressure regulating valve. The corresponding set values for travel, speed, and pressure are fed to the control device. By means of the signals obtained by the metal sensor, the control device (15) can perform an exact real-time control of the injection process that is independent of the bath level in the vat (1).

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. In a hot-chamber diecasting machine in which an injection process is influenced by an electronic control device to which input signals from an injection assembly are supplied, said diecasting machine having a casting container which dips into a melt and has a riser with a mouthpiece body mounted thereon, the mouthpiece body being guided with a nozzle tip up to a mold, the improvement comprising:

a metal sensor operatively arranged in a vicinity of a tip of the mouthpiece body, said metal sensor being connected with the electronic control device for feeding input signals to said electronic control device; and high-dynamic continuous valves having switching times between 1 and 5 ms arranged to influence the injection process, said high-dynamic continuous valves being actuated by said electronic control device and permitting speed and pressure regulation which is suitable for a product to be cast.

2. The hot-chamber diecasting machine according to claim 1, wherein said mouthpiece body includes a receptacle into which the nozzle tip is inserted; and wherein a receiving chamber is formed between said mouthpiece body and said nozzle tip in which is placed said metal sensor.

3. The hot-chamber diecasting machine according to claim 1, further comprising an evacuation device having a vacuum pump and a valve associated with said mold, said valve being located upstream from said vacuum pump and being operable by said electronic control device.

4. The hot-chamber diecasting machine according to claim 1, wherein said metal sensor is a non-contacting sensor which reacts to a presence of a metal melt.

5. The hot-chamber diecasting machine according to claim 4, wherein said non-contacting sensor is a magnetic field sensor.

6. The hot-chamber diecasting machine according to claim 1, wherein said metal sensor is an electrical sensor having a contact surface, said electrical sensor being operatively arranged in said mouthpiece body.

7. In a hot-chamber diecasting machine, the improvement comprising:

a metal sensor operatively arranged in a vicinity of a tip of a mouthpiece body, said metal sensor providing signals indicating a presence of a metal front;

high-dynamic continuous valves having switching times between 1 and 5 ms operatively arranged so as to influence an injection process for the hot-chamber diecasting machine; and an electronic control device which receives the signals from said metal sensor and which actuates said high-dynamic continuous valves permitting desired speed and pressure regulation for a product being diecast.

* * * * *